US010932561B2

(12) United States Patent
Zhang et al.

(10) Patent No.: US 10,932,561 B2
(45) Date of Patent: Mar. 2, 2021

(54) STEPLESS ADJUSTABLE TELESCOPIC DEVICE AND METHOD USING THE SAME

(71) Applicant: ZHUHAI RUNXINGTAI ELECTRICAL CO., LTD., Zhuhai (CN)

(72) Inventors: Ying Zhang, Zhuhai (CN); Huaide Ren, Zhuhai (CN); Yuan Huo, Zhuhai (CN); Wentao Wang, Zhuhai (CN)

(73) Assignee: ZHUHAI RUNXINGTAI ELECTRICAL CO., LTD., Zhuhai (CN)

( * ) Notice: Subject to any disclaimer, the term of this patent is extended or adjusted under 35 U.S.C. 154(b) by 0 days.

(21) Appl. No.: 16/656,079

(22) Filed: Oct. 17, 2019

(65) Prior Publication Data

US 2021/0030147 A1 Feb. 4, 2021

(30) Foreign Application Priority Data

Aug. 2, 2019 (CN) ..... 201910711487.7

(51) Int. Cl.
*A47B 21/02* (2006.01)

(52) U.S. Cl.
CPC ..... *A47B 21/02* (2013.01)

(58) Field of Classification Search
CPC ..... A47B 21/02; A47B 9/16; B66F 7/0666; B66F 11/042
USPC ..... 108/145; 248/562; 254/122
See application file for complete search history.

(56) References Cited

U.S. PATENT DOCUMENTS 3,302,971 A * 2/1967 Lory ..... A61G 15/02 297/344.14
3,703,147 A * 11/1972 Selander ..... A47B 27/18 108/145
4,073,240 A * 2/1978 Fly ..... A47B 9/16 108/145
4,638,610 A * 1/1987 Heikkinen ..... B66F 7/0608 108/145
4,747,353 A * 5/1988 Watt ..... A47B 9/02 108/145

(Continued)

FOREIGN PATENT DOCUMENTS

JP 3206353 U * 9/2016 ..... A47B 21/04

*Primary Examiner* — Jose V Chen
(74) *Attorney, Agent, or Firm* — Anova Law Group, PLLC

(57) ABSTRACT

A stepless adjustable telescopic device includes a first support, a second support, and a folding arm connecting the first support to the second support. The folding arm includes a first quadrangular structure, a second quadrangular structure, and a power support device connected to the first quadrangular structure. A first end of the first quadrangular structure is rotatably connected to the first support. A first end of the second quadrangular structure is rotatably connected to the second support, and a second end of the second quadrangular structure is rotatably connected to a second end of the first quadrangular structure via a rotary connection structure. The power support device and the first quadrangular structure form a triangular structure, and the power support device is configured to drive the first quadrangular structure to rotate such that the first quadrangular structure drives the second quadrangular structure to rotate synchronously with the first quadrangular structure.

15 Claims, 2 Drawing Sheets

(56) References Cited

U.S. PATENT DOCUMENTS

| | | | | | |
|---|---|---|---|---|---|
| 5,005,492 | A * | 4/1991 | Ogino | B66F 7/0641 | 108/145 |
| 5,758,849 | A * | 6/1998 | Bui | A47B 9/10 | 248/125.1 |
| 5,823,120 | A * | 10/1998 | Holmquist | A47B 9/02 | 108/147 |
| 5,953,776 | A * | 9/1999 | Sanders | A61B 6/0457 | 108/145 |
| 6,038,986 | A * | 3/2000 | Ransil | A47B 9/02 | 108/145 |
| 6,283,047 | B1 * | 9/2001 | Haller(-Hess) | A47B 9/02 | 108/145 |
| 6,502,261 | B1 * | 1/2003 | Harwood | A61B 6/0457 | 108/145 |
| 8,065,966 | B1 * | 11/2011 | Bacon | A47B 9/16 | 108/145 |
| 8,132,518 | B2 * | 3/2012 | Kim | B66F 7/0633 | 108/145 |
| 9,961,991 | B1 * | 5/2018 | Chen | A47B 9/16 | |
| 2003/0154890 | A1 * | 8/2003 | Warner | A47B 9/00 | 108/145 |
| 2007/0034125 | A1 * | 2/2007 | Lo | B66F 7/0666 | 108/145 |
| 2007/0266912 | A1 * | 11/2007 | Swain | A47B 9/02 | 108/145 |
| 2013/0139736 | A1 * | 6/2013 | Flaherty | A47B 9/16 | 108/106 |
| 2015/0289641 | A1 * | 10/2015 | Ergun | A47B 9/18 | 108/42 |
| 2017/0020280 | A1 * | 1/2017 | Chuang | F16M 11/08 | |
| 2017/0251805 | A1 * | 9/2017 | Graham | F16M 11/046 | |
| 2017/0360192 | A1 * | 12/2017 | Hu | A47B 9/16 | |
| 2018/0332957 | A1 * | 11/2018 | Li | A47B 23/04 | |

* cited by examiner

STEPLESS ADJUSTABLE TELESCOPIC DEVICE AND METHOD USING THE SAME

CROSS-REFERENCE TO RELATED APPLICATION

This application claims priority to Chinese Application No. 201910711487.7, filed Aug. 2, 2019, the entire content of which is incorporated herein by reference.

TECHNICAL FIELD

The present disclosure relates to the technical field of machinery, and in particular to a stepless adjustable telescopic device.

BACKGROUND

Recently, with the development and popularization of the computer technology, more and more people work or study by computers. In order to better keep a correct posture for office work to prevent modern occupational diseases, lifting desks have been proposed so that the people's demands for adjusting the height for office work are satisfied.

At present, small and medium-sized lifting desks in the market are usually lifted up or lowered down by a single arm. During the lifting process, the desktop will obviously displace front and back or left and right, great influence will be caused to the surroundings. Moreover, the small and medium-sized lifting desks cannot provide a sufficient height for lifting up or lowering down.

SUMMARY

The present disclosure is aimed at solving the problems described above. An objective of the present disclosure is to provide a stepless adjustable telescopic device for solving any one of the problems described above. Particularly, the present disclosure provides a stepless adjustable telescopic device which can realize small influence to the surroundings, a small occupied space and a large telescopic range.

According to a first aspect of the present disclosure, the present disclosure provides a stepless adjustable telescopic device, including a first support, a second support and at least one folding arm, wherein the at least one folding arm includes a first quadrangular structure and a second quadrangular structure; a first end of the first quadrangular structure is rotatably connected to the first support, and a first end of the second quadrangular structure is rotatably connected to the second support; a second end of the first quadrangular structure is rotatably connected to a second end of the second quadrangular structure via a rotary connection structure; the at least one folding arm further includes a power support device which is connected to the first quadrangular structure to form a triangular structure; and, the power support device provides power to drive the first quadrangular structure to rotate such that the first quadrangular structure drives the second quadrangular structure to rotate synchronously.

The stepless adjustable telescopic device can be further characterized in that:

the first quadrangular structure is a parallelogram structure and the second quadrangular structure is a parallelogram structure.

The stepless adjustable telescopic device can be further characterized in that:

the rotary connection structure includes a connection frame and a rotation structure; the rotation structure includes a first rotary wheel and a second rotary wheel; the first rotary wheel is rotatably connected to the connection frame to form a rotation point B; the second rotary wheel is rotatably connected to the connection structure to form a rotation point E; and, the first rotary wheel and the second rotary wheel move towards each other under the action of the power support device.

The stepless adjustable telescopic device can be further characterized in that:

the first quadrangular structure includes a first connecting rod and a second connecting rod, with a first end of the first connecting rod being rotatably connected to the first support 1 to form a rotation point A, a second end of the first connecting rod being fixedly connected to the first rotary wheel, a first end of the second connecting rod being rotatably connected to the first support to form a rotation point D, a second end the second connecting rod being rotatably connected to the connection frame to form a rotation point C, wherein the points A, B, C and D form the first quadrangular structure; and, the second quadrangular structure includes a third connecting rod and a fourth connecting rod, with a second end of the third connecting rod being fixedly connected to the second rotary wheel, a first end of the third connecting rod being rotatably connected to the second support to form a rotation point F, a second end of the fourth connecting rod being rotatably connected to the connection frame to form a rotation point H, a first end of the fourth connecting rod being rotatably connected to the second support to form a rotation point G, wherein the points E, F, G and H form the second quadrangular structure.

The stepless adjustable telescopic device can be further characterized in that:

$$AB=CD=EF=GH.$$

The stepless adjustable telescopic device can be further characterized in that:

AD=BC=EH=FG, and the first quadrangular structure and the second quadrangular structure are symmetrical about the rotation structure.

The stepless adjustable telescopic device can be further characterized in that:

the power support device includes a stepless telescopic rod, an adjustment lever and a controller; a first end of the stepless telescopic rod is connected to the rotation point A or the rotation point D, a second end of the stepless telescopic rod is connected to the adjustment lever to form a point I; a first end of the adjustment lever is rotatably connected to the rotation point B, a second end of the adjustment lever is rotatably connected to the rotation point C; the stepless telescopic rod is electrically connected to the controller; and, the controller can control the extension or contraction of the stepless telescopic rod.

The stepless adjustable telescopic device can be further characterized in that:

the rotation mechanism is one of a meshing gear, a friction wheel, a chain gear, a steel wire wheel and a belt wheel.

The stepless adjustable telescopic device can be further characterized in that:

The stepless adjustable telescopic device is a stepless adjustable lifting desk and further includes a panel and a pedestal, the panel is fixedly connected to the first support, and the pedestal is fixedly connected to the second support.

According to another aspect of the present disclosure, a method for using a stepless adjustable telescopic device is provided, including the following steps of:

activating an extension control operation of a controller so that a stepless telescopic rod begins to extend gradually and ∠BAC formed by points B, A and C increases gradually;

deforming a first quadrangular structure to drive a second quadrangular structure to synchronously deform to generate power for rotation, so as to allow a first connecting rod to drive a first rotary wheel to rotate counterclockwise, and allow the first rotary wheel to simultaneously drive a second rotary wheel to rotate clockwise, so that an included angle between the first quadrangular structure and the second quadrangular structure increases gradually; and the extension control operation of the controller is stopped when a folding arm is gradually extended to a predetermined displacement;

or, activating a contraction control operation of the controller so that the stepless telescopic rod begins to contract gradually and ∠BAC formed by points B, A and C decreases gradually; deforming the first quadrangular structure to drive the second quadrangular structure to synchronously deform to generate power for rotation, so as to allow the first connecting rod to drive the first rotary wheel to rotate clockwise, and allow the first rotary wheel to simultaneously drive the second rotary wheel to rotate counterclockwise, so that an included angle between the first quadrangular structure and the second quadrangular structure decreases gradually; and the contraction control operation of the controller is stopped when the folding arm is gradually contracted to a predetermined displacement.

The stepless adjustable telescopic device of the present disclosure is simple in structure and easy to mount, and the method for using the stepless adjustable telescopic device is easy to operate. During the use process, under the action of the power support device, the first quadrangular structure and the second quadrangular structure of the folding arm are simultaneously deformed and rotated, so that the included angle α between the first quadrangular structure and the second quadrangular structure changes, and the first support and the second support are always lifted up or lowered down in the same straight line without shaking. The stepless adjustable telescopic device has small influence to the surroundings, a small occupied space and a large telescopic range, and the convenience and practicability of the stepless adjustable telescopic device are greatly improved.

Other characteristics, features and advantages of the present disclosure will become apparent by reading the following descriptions of the exemplary embodiments with reference to the drawings.

BRIEF DESCRIPTION OF THE DRAWINGS

The embodiments of the present disclosure are shown by the drawings that are incorporated in this specification and constitute a part of this specification, and these drawings together with the descriptions are used for explaining the principle of the present disclosure. Throughout the drawings, like reference numerals are used to indicate like elements. The drawings in the following descriptions are some but not all of the embodiments of the present disclosure. A person of ordinary skill in the art can obtain other drawings according to the drawings without paying any creative effort.

DETAILED DESCRIPTION OF EMBODIMENTS

To make the objectives, technical solutions and advantages of the present disclosure clearer, the technical solutions in the embodiments of the present disclosure will be described in detail below with reference to the drawings of the present disclosure. Apparently, the described embodiments are some but not all of the embodiments of the present disclosure. All other embodiments obtained by those skilled in the art on the basis of the embodiments in the present disclosure without paying any creative effort shall fall into the protection scope of the present disclosure. It is to be noted that the embodiments in the present application and the features in the embodiments can be combined with each other if not conflicted.

In the present disclosure, by allowing a first quadrangular structure and a second quadrangular structure of a folding arm to be simultaneously deformed and rotated under the action of a power support device during the extension or contraction process of the folding arm, the included angle α between the first quadrangular structure and the second quadrangular structure increases or decreases, so that a first support and a second support are allowed to do a reciprocating motion on a same straight line, so as to realize the extension/contraction action of the stepless adjustable telescopic device. The stepless adjustable telescopic device has small influence to the surroundings and a large telescopic range. Specifically, the stepless adjustable telescopic device of the present disclosure has simple structure and reduced production cost, and can be quickly and conveniently used by a user, so that the convenience and practicability of the stepless adjustable telescopic device are greatly improved.

The stepless adjustable telescopic device and the method using the same in the present disclosure will be described below in detail with reference to the drawings.

Figure 1:
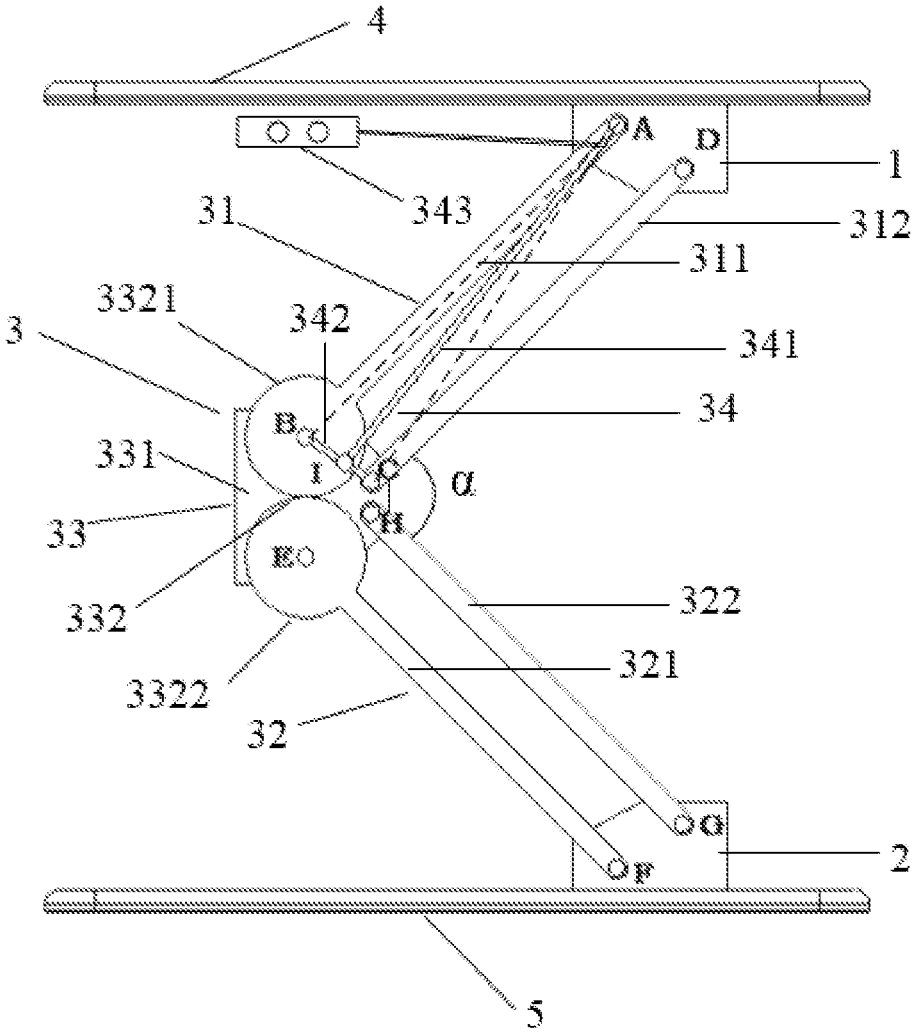
FIG. 1 shows a schematic structural diagram of a stepless adjustable telescopic device according to the present disclosure.

FIG. 1 shows a schematic structural diagram of an example stepless adjustable telescopic device according to the present disclosure. In the example shown in FIG. 1, the stepless adjustable telescopic device is a stepless adjustable lifting desk. The stepless adjustable lifting desk includes a first support 1, a second support 2, at least one folding arm 3, a panel 4 and a pedestal 5. The panel 4 may be fixedly connected to the first support 1 perpendicularly by a screw, and the pedestal 5 may be fixedly connected to the second support 2 perpendicularly by a screw, so that the desktop is parallel to the horizontal plane (as in the figure). The folding arm 3 includes a first quadrangular structure 31, a second quadrangular structure 32, a rotary connection device 33 and a power support device 34. A first end of the first quadrangular structure 31 is rotatably connected to the first support 1, a first end of the second quadrangular structure 32 is rotatably connected to the second support 2, and a second end of the first quadrangular structure 31 is rotatably connected to the first end of the second quadrangular structure 32 via the rotary connection device 33. A first end of the power support device 34 is rotatably connected to the first end of the first quadrangular structure, while a second end of the power support device 34 is rotatably connected to the second end of the first quadrangular structure. The power support device 34 and the first quadrangular structure 31 form a triangular structure. During the extension or contraction process, the power support device enables a rotation mechanism 332 to rotate to generate power for allowing the second quadrangular structure 32 and the first quadrangular structure 31 to synchronously rotate, so that the included angle α between the second quadrangular structure 32 and the first quadrangular structure 31 increases or decreases, so as to lift up or lower down the desktop (i.e., the panel 4). The stepless adjustable lifting desk has small influence to the surroundings and a large telescopic range. Consistent with the disclosure, with the power support device for providing uniform power for the extension or contraction of the folding arm, the stepless adjustable lifting desk is stable during the lifting-up or lowering-down process.

The rotary connection device 33 includes a connection frame 331 and a rotation mechanism 332 (also referred to as a "rotation structure"). The connection frame 331 is connected to the rotation mechanism 332. The rotation structure 332 includes a first rotary wheel 3321 and a second rotary wheel 3322. The first rotary wheel 3321 is rotatably connected to the connection frame 331 to form a rotation point B, and the second rotary wheel 3322 is rotatably connected to the connection frame 331 to form a rotation point E. Due to the push force applied to the first quadrangular structure 31 by the power support device 34 during the extension process, the first rotary wheel 3321 and the second rotary wheel 3322 move towards each other, and it is realized that the second rotary wheel 3322 is driven to drive the second quadrangular structure 32 to deform when the first rotary wheel 3321 drives the first quadrangular structure 31 to deform, so that the included angle α between the first quadrangular structure 31 and the second quadrangular structure 32 increases and the desktop moves up in a vertical direction. Similarly, due to the pull force applied to the first quadrangular structure by the power support device 34 during the contraction process, the first rotary wheel 3321 and the second rotary wheel 3322 move towards each other, and it is realized that the second rotary wheel 3322 is driven to drive the second quadrangular structure 32 to deform when the first rotary wheel 3321 drives the first quadrangular structure 31 to deform, so that the included angle α between the first quadrangular structure 31 and the second quadrangular structure 32 decreases and the desktop moves down in the vertical direction.

To achieve the above effects, in some embodiments, as shown in FIG. 1, the first quadrangular structure 31 may include a parallelogram structure and the second quadrangular structure 32 may also include a parallelogram structure. By fixing the included angle between the desktop 4 and the first support 1 and the included angle between the pedestal 5 and the second support 2 without rotation, the desktop 4 is always parallel to the pedestal 5 during the lifting-up or lowering-down process and will not displace left and right during the vertical lifting up and lowering down process.

In some embodiments, the first quadrangular structure 31 includes a first connecting rod 311 and a second connecting rod 312. In some embodiments, the first connecting rod 311 and the second connecting rod 312 are approximately parallel to each other. A first end of the first connecting rod 311 is rotatably connected to the first support 1 to form a rotation point A, while a second end of the first connecting rod 311 is fixedly connected to the first rotary wheel 3321. A first end of the second connecting rod 312 is rotatably connected to the first support 1 to form a rotation point D, while a second end of the second connecting rod 312 is rotatably connected to the connection frame 331 to form a rotation point C, wherein the points A, B, C and D form the first quadrangular structure. Accordingly, the second rotary wheel may drive the first connecting rod 311 to rotate during its rotation, so as to drive the first quadrangular structure to deform. The second quadrangular structure 32 includes a third connecting rod 321 and a fourth connecting rod 322. In some embodiments, the third connecting rod 321 and the fourth connecting rod 322 are approximately parallel to each other. A second end of the third connecting rod 321 is fixedly connected to the second rotary wheel 3322, while a first end of the third connecting rod 321 is rotatably connected to the second support 2 to form a rotation point F; and, a second end of the fourth connecting rod 322 is rotatably connected to the connection frame 331 to form a rotation point H, and a first end of the fourth connecting rod 322 is rotatably connected to the second support 2 to form a rotation point G, wherein the points E, F, G and H form the second quadrangular structure 32. Accordingly, when the first rotary wheel 3321 drives the second rotary wheel to rotate, the second rotary wheel 3322 drives the third connecting rod 321 to rotate, so as to drive the second quadrangular structure 32 and the first quadrangular structure 31 to simultaneously deform.

In some embodiments, AB=CD=EF=GH, AD=BC=EH=FG, where AB, CD, EF, GH, AD, BC, EH, and FG refer to the distance between points A and B, the distance between points C and D, the distance between points E and F, the distance between points G and H, the distance between points A and D, the distance between points B and C, the distance between points E and H, and the distance between points F and G, respectively. Further, the first quadrangular structure 31 and the second quadrangular structure 32 are symmetrical about the rotation structure 332, so that the desktop (i.e., the panel 4) is always parallel to the horizontal plane (as in the figure). In the process of increasing the included angle α between the first quadrangular structure 31 and the second quadrangular structure 32, due to the extension of the power support device 34, the first support 1 can be linearly lifted up in the longitudinal direction of the second support 2 without shaking. It should be understood that, in the process of allowing the first quadrangular structure 31 and the second quadrangular structure 32 to deform simultaneously during contraction of the power support device 34, to decrease the angle α between the first quadrangular structure and the second quadrangular structure, the first support 1 is linearly lowered down in the longitudinal direction of the second support 2 without shaking. Accordingly, the space occupied by the stepless adjustable lifting desk during its lifting-up process is greatly reduced.

The power support device 34 includes a stepless telescopic rod 341, an adjustment lever 342 and a controller 343. The stepless telescopic rod 341 is connected to both ends of the first quadrangular structure 31. Specifically, a first end of the stepless telescopic rod 341 is connected to the rotation point A or the rotation point D, while a second end of the stepless telescopic rod 341 is connected to the adjustment lever 342 to form a point I. The point I may be a rotation point for realizing the position adjustment of the stepless telescopic rod 341 in a horizontal axis direction of the adjustment lever 342. The point I may also be a fixed point to enable the stepless telescopic rod to be adjustably fixed at a predetermined position on the adjustment lever. A first end of the adjustment lever 342 is rotatably connected to the rotation point B, while a second end of the adjustment lever 342 is rotatably connected to the rotation point C. The stepless telescopic rod 341 is electrically connected to the controller 343, and the controller 343 can control the extension or contraction of the stepless telescopic rod 341. Accordingly, the extension or contraction motion of the stepless adjustable lifting device can be realized only by operating the controller, and the use convenience of the user is improved.

In some embodiments, the rotation mechanism 332 may be a meshing gear, a friction wheel, a chain gear, a steel wire wheel or a belt wheel.

In some embodiments, the stepless telescopic rod 341 may be a pneumatic spring, and the adjustment lever may be a threaded rod.

Figure 2:
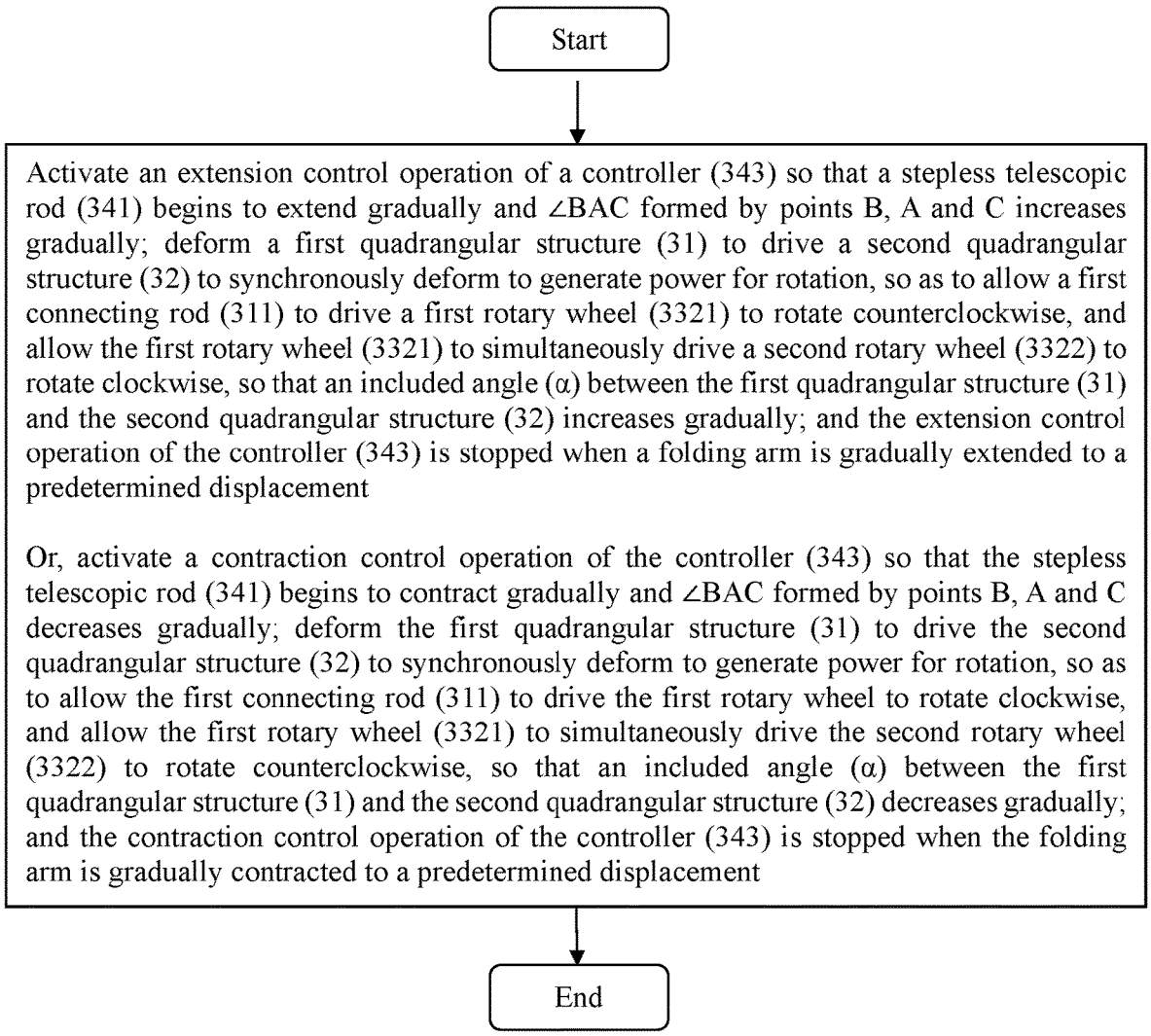
FIG. 2 is a flowchart of a method for using a stepless adjustable telescopic device according to the present disclosure.

Corresponding to the stepless adjustable telescopic device, the present disclosure further provides a method for using the stepless adjustable telescopic device. FIG. 2 shows a flowchart of an example method of using the stepless adjustable telescopic device. As shown in FIG. 2, the method includes the following.

An extension control operation of the controller 343 is activated, so that the stepless telescopic rod 341 begins to extend gradually, and an angle ∠BAC formed by the points B, A and C, i.e., an angle formed by a line segment connecting points B and A and a line segment connecting points C and A, increases gradually. The first quadrangular structure 31 is deformed to drive the second quadrangular structure 32 to synchronously deform so as to generate power for rotation, that is, the first connecting rod 311 drives the first rotary wheel 3321 to rotate counterclockwise and the first rotary wheel 3321 simultaneously drives the second rotary wheel 3322 to rotate clockwise, so that the included angle α between the first quadrangular structure 31 and the second quadrangular structure 32 increases gradually. The extension control operation of the controller 343 is stopped when the folding arm has gradually extended for a predetermined displacement.

Or, a contraction control operation of the controller 343 is activated, so that the stepless telescopic rod 341 begins to contract gradually, and the angle ∠BAC formed by the points B, A and C decreases gradually. The first quadrangular structure 31 is deformed to drive the second quadrangular structure 32 to synchronously deform, that is, the first connecting rod 311 drives the first rotary wheel to rotate clockwise and the first rotary wheel 3321 simultaneously drives the second rotary wheel 3322 to rotate counterclockwise, so that the included angle α between the first quadrangular structure 31 and the second quadrangular structure 32 decreases gradually. The contraction control operation of the controller 343 is stopped when the folding arm has gradually contracted for a predetermined displacement.

It should be understood that the method for using a stepless adjustable telescopic device is also applicable to the stepless adjustable lifting desk. Before the use of the stepless adjustable lifting desk, it is possible to first fix the pedestal 5 and then activate the extension control operation of the controller 343. The stepless telescopic rod automatically begins to extend gradually or an operator manually lifts up the desktop to extend the stepless telescopic rod, so that the angle ∠BAC formed by the points B, A and C increases gradually, i.e., the included angle α between the first quadrangular structure 31 and the second quadrangular structure 32 increases gradually. Accordingly, the desktop (i.e., the panel 4) is steadily lifted up in the vertical direction. When the desktop is lifted up to a predetermined height suitable for the operator, the extension control operation of the controller is stopped, and the desktop steadily stays at the predetermined height. When it is necessary to lower the height of the desktop, the contraction control operation of the controller 343 is activated, and the stepless telescopic rod automatically beings to contract gradually or the operator manually presses the desktop to contract the stepless telescopic rod, so that the desktop (i.e., the panel 4) is steadily lowered down in the vertical direction, and the angle ∠BAC formed by the points B, A and C decreases gradually, i.e., the included angle α between the first quadrangular structure 31 and the second quadrangular structure 32 decreases gradually. When the desktop is lowered down to a predetermined height suitable for the operator, the contraction control operation of the controller is stopped, and the desktop steadily stays at the predetermined height. The stepless adjustable telescopic device can be quickly and conveniently used by the operator, and the convenience and practicability of the stepless adjustable telescopic device are improved.

The controller 343 of the stepless adjustable telescopic device may also be provided with an extension control key and a contraction control key. For example, when the extension control key is long pressed, the stepless adjustable telescopic device begins to extend; and, when the stepless adjustable telescopic device is extended for a certain displacement, the extension control key is released, so that the stepless adjustable telescopic device stops extending. When the contraction control key is long pressed, the stepless adjustable telescopic device begins to contact; and, when the stepless adjustable telescopic device is contracted for a certain displacement, the contraction control key is released, so that the stepless adjustable telescopic device stops contracting.

In order to increase the bearing capacity and stability of the stepless adjustable telescopic device, a plurality of folding arms may be provided between the panel 4 and the pedestal 5. For example, another folding arm is further provided in the above stepless adjustable telescopic device. It should be understood that two folding arms can be provided between the panel 4 and the pedestal 5. By arranging the bent parts of the two folding arms on the same horizontal line in opposite directions or in the same direction and connecting the controllers of the two folding arms to a same controller, the synchronous extension or contract of the two folding arms can be realized by one controller, and the panel is always kept in the horizontal state during the lifting or lowering process.

The stepless adjustable telescopic device of the present disclosure is simple in structure and easy to mount, and the method for using the stepless adjustable telescopic device is easy to operate. During the use process, under the action of the power support device, the first quadrangular structure and the second quadrangular structure of the folding arm are deformed simultaneously and rotated, so that the included angle α between the first quadrangular structure and the second quadrangular structure changes, and the first support and the second support are always lifted up and lowered down in the same straight line without shaking. The stepless adjustable telescopic device has small influence to the surroundings, a small occupied space and a large telescopic range, and the convenience and practicability of the stepless adjustable telescopic device are greatly improved.

The contents described above can be implemented separately or in various combinations, and all the variations shall fall into the protection scope of the present disclosure.

It is to be noted that, as used herein, the term "comprise," "include" or any other variant thereof is intended to cover any non-exclusive inclusion, so that a process, method, article or device including a series of elements not only includes these elements, but also includes other elements that are not expressly listed, or elements inherent to this process, method, article or device. Without further restrictions, an element defined by the statement "comprising a/an . . . " does not exclude the presence of other identical elements in the process, method, article or device including this element.

Finally, it is to be noted that the foregoing embodiments are merely for describing the technical solutions of the present disclosure, rather than limiting the present disclosure. Although the present disclosure has been described above in detail by the foregoing embodiments, it should be understood by a person of ordinary skill in the art that the technical solutions recorded in the foregoing embodiments can still be modified or some technical features can be equivalently replaced. However, these modifications or replacements do not make the essence of the corresponding technical solutions depart from the spirit and scope of the technical solutions of the embodiments of the present disclosure.

What is claimed is:

1. A stepless adjustable telescopic device comprising:
- a first support;
- a second support; and
- a folding arm connecting the first support to the second support, the folding arm including:
  - a first quadrangular structure, a first end of the first quadrangular structure being rotatably connected to the first support;
  - a second quadrangular structure, a first end of the second quadrangular structure being rotatably connected to the second support, and a second end of the second quadrangular structure being rotatably connected to a second end of the first quadrangular structure via a rotary connection structure; and
  - a power support device, a first end of the power support device being rotatably connected to the first end of the first quadrangular structure, a second end of the power support device being rotatably connected to the second end of the first quadrangular structure, the power support device and the first quadrangular structure forming a triangular structure, and the power support device being configured to drive the first quadrangular structure to rotate such that the first quadrangular structure drives the second quadrangular structure to rotate with the first quadrangular structure via the rotary connection structure.

2. The stepless adjustable telescopic device according to claim 1, wherein the first quadrangular structure includes a parallelogram structure and the second quadrangular structure includes a parallelogram structure.

3. The stepless adjustable telescopic device according to claim 1, wherein the rotary connection structure includes:
- a connection frame; and
- a rotation structure including:
  - a first rotary wheel rotatably connected to the connection frame at a first point; and
  - a second rotary wheel rotatably connected to the connection frame at a second point and being coupled to the first rotary wheel.

4. The stepless adjustable telescopic device according to claim 3, wherein the first quadrangular structure includes:
- a first connecting rod, a first end of the first connecting rod being rotatably connected to the first support at a third point, and a second end of the first connecting rod being fixedly connected to the first rotary wheel; and
- a second connecting rod, a first end of the second connecting rod being rotatably connected to the first support at a fourth point, and a second end of the second connecting rod being rotatably connected to the connection frame at a fifth point;
- wherein the first point, the third point, the fourth point, and the fifth point constitute four vertices of the first quadrangular structure.

5. The stepless adjustable telescopic device according to claim 4, wherein the first connecting rod and the second connecting rod are parallel to each other.

6. The stepless adjustable telescopic device according to claim 5, wherein a distance between the third point and the fourth point, a distance between the first point and the fifth point, a distance between the second point and the eighth point, and a distance between the sixth point and the seventh point approximately equal each other.

7. The stepless adjustable telescopic device according to claim 4, wherein the second quadrangular structure includes:
- a third connecting rod, a first end of the third connecting rod being rotatably connected to the second support at a sixth point, and a second end of the third connecting rod being fixedly connected to the second rotary wheel; and
- a fourth connecting rod, a first end of the fourth connecting rod being rotatably connected to the second support at a seventh point, and a second end of the fourth connecting rod being rotatably connected to the connection frame at an eighth point;
- wherein the second point, the sixth point, the seventh point, and the eighth point constitute four vertices of the second quadrangular structure.

8. The stepless adjustable telescopic device according to claim 7, wherein the third connecting rod and the fourth connecting rod are parallel to each other.

9. The stepless adjustable telescopic device according to claim 7, wherein a distance between the first point and the third point, a distance between the fourth point and the fifth point, a distance between the second point and the sixth point, and a distance between the seventh point and the eighth point approximately equal each other.

10. The stepless adjustable telescopic device according to claim 3, wherein the first quadrangular structure and the second quadrangular structure are symmetrical about the rotation structure.

11. The stepless adjustable telescopic device according to claim 1, wherein the power support device includes:
- an adjustment lever, a first end of the adjustment lever being rotatably connected to a point at which the first quadrangular structure connects to the rotary connection structure, and a second end of the adjustment lever being rotatably connected to another point at which the first quadrangular structure connects to the rotary connection structure; and
- a stepless telescopic rod, a first end of the stepless telescopic rod being connected to a point at which the first quadrangular structure connects to the first support, and a second end of the stepless telescopic rod being connected to the adjustment lever.

12. The stepless adjustable telescopic device according to claim 11, wherein the power support device further includes a controller electrically coupled to the stepless telescopic rod and configured to execute an extension control operation to cause the stepless telescopic rod to extend or execute a contraction control operation to cause the stepless telescopic rod to contract.

13. The stepless adjustable telescopic device according to claim 1, further comprising:
- a panel fixedly connected to the first support; and
- a pedestal fixedly connected to the second support.

14. A method of using the stepless adjustable telescopic device of claim 1 comprising:

activating an extension control operation of a controller of the stepless adjustable telescopic device to control a telescopic rod of the power support device to extend gradually;

rotating the first quadrangular structure to drive the second quadrangular structure to rotate to generate power for rotation, so as to allow a first connecting rod of the first quadrangular structure to drive a first rotary wheel of the rotary connection structure to rotate counterclockwise, and allow the first rotary wheel to simultaneously drive a second rotary wheel of the rotary connection structure to rotate clockwise, so that an included angle between the first quadrangular structure and the second quadrangular structure increases gradually; and stopping the extension control operation of the controller in response to the folding arm having extended for a predetermined displacement.

15. A method of using the stepless adjustable telescopic device of claim 1 comprising:

activating a contraction control operation of a controller of the stepless adjustable telescopic device to control a telescopic rod of the power support device to contract gradually;

rotating the first quadrangular structure to drive the second quadrangular structure to rotate to generate power for rotation, so as to allow a first connecting rod of the first quadrangular structure to drive a first rotary wheel of the rotary connection structure to rotate clockwise, and allow the first rotary wheel to simultaneously drive a second rotary wheel of the rotary connection structure to rotate counterclockwise, so that an included angle between the first quadrangular structure and the second quadrangular structure decreases gradually; and stopping the contraction control operation of the controller in response to the folding arm having contracted for a predetermined displacement.

* * * * *